United States Patent [19]

Lux et al.

[11] 4,164,989

[45] Aug. 21, 1979

[54] MUFFLER, ESPECIALLY FOR PORTABLE INTERNAL COMBUSTION ENGINE

[75] Inventors: Helmut Lux, Waiblingen; Götz Landwehr, Berglen, both of Fed. Rep. of Germany

[73] Assignee: Andreas Stihl, Waiblingen, Fed. Rep. of Germany

[21] Appl. No.: 913,030

[22] Filed: Jun. 7, 1978

[30] Foreign Application Priority Data

Jun. 8, 1977 [DE] Fed. Rep. of Germany ..... 2725899

[51] Int. Cl.[2] ..... F01N 1/08

[52] U.S. Cl. ..... 181/265; 181/259; 181/270; 181/272; 181/275

[58] Field of Search ..... 181/264, 265, 267, 268, 181/269, 272, 275, 240, 259, 270

[56] References Cited

U.S. PATENT DOCUMENTS

| | | | |
|---|---|---|---|
| 2,774,439 | 12/1956 | Chesser | 181/264 |
| 3,378,099 | 4/1968 | Gordon | 181/240 |
| 3,650,354 | 3/1972 | Gordon | 181/240 |
| 3,968,854 | 7/1976 | Gordon et al. | 181/269 |

*Primary Examiner*—L. T. Hix

*Assistant Examiner*—Benjamin R. Fuller

*Attorney, Agent, or Firm*—Becker & Becker, Inc.

[57] ABSTRACT

A muffler, especially for a portable internal combustion engine, particularly for driving a motor chain saw, which muffler comprises an exhaust gas receiving chamber which is defined by a chamber wall and by a pan-shaped housing wall including an inlet for the exhaust gases. Arranged on the inside surface of the chamber wall there is arranged an exhaust gas conveying passage communicating with the exhaust gas chamber and being adapted to deflect an exhaust gas current by preferably 90°. This passage is adapted to convey the thus deflected exhaust gas current through an aperture in the chamber wall. Above this aperture on the outside of the chamber wall and projecting therefrom there is provided a bend from which the exhaust gas current through an outlet in the bend flows at least approximately parallel to a portion of the chamber wall. Furthermore, transverse to the out-flow direction of the exhaust current and spaced from the last mentioned outlet at least one turbulence creating member is provided for creating turbulence in the exhaust current having passed through the outlet.

17 Claims, 10 Drawing Figures

Fig.3
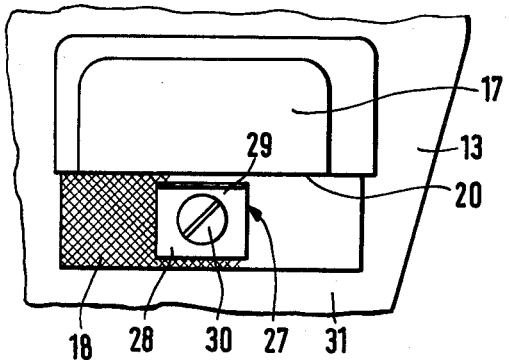
Fig.4
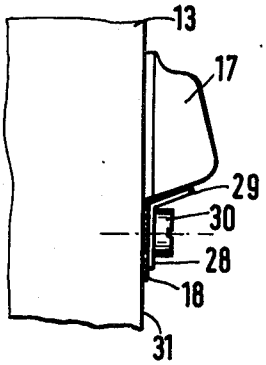
Fig.5
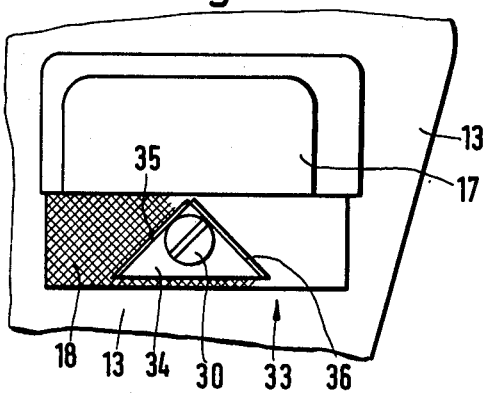
Fig.6
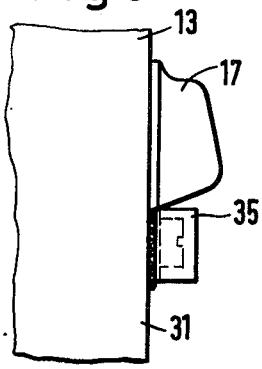
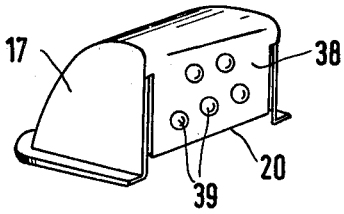
Fig.7

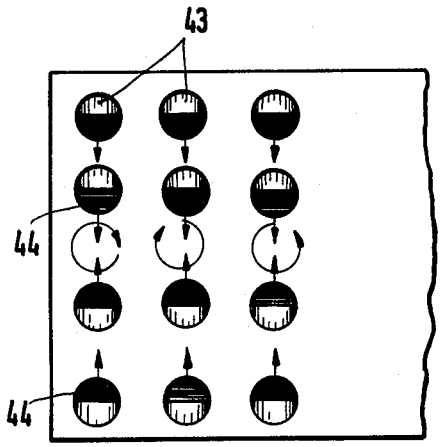
Fig.9
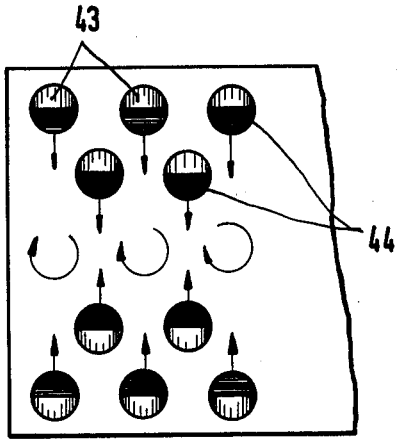
Fig.10
Fig.8
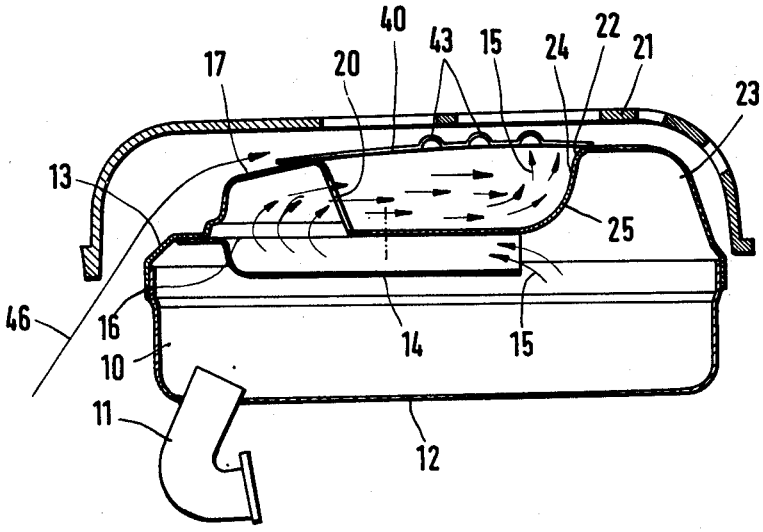

MUFFLER, ESPECIALLY FOR PORTABLE INTERNAL COMBUSTION ENGINE

The present invention relates to a muffler for a portable internal combustion engine, especially for an internal combustion engine for driving a motor chain saw.

For internal combustion engines for driving portable motor saws, especially motor chain saws, mufflers have become known which for safety reasons are governed by strict protective regulations. In this connection, the temperatures at the surface of the muffler should not exceed 28° C., and the temperature of the exhaust gases at the exit from the machine contour (muffler/ cover protection) should not exceed 246° C.

It is an object of the present invention with an exhaust muffler of the above mentioned general type to assure that the temperature of the discharged exhaust gases on a cover protection determining the temperature measuring surface and extending over the muffler, as well as the temperature of said cover protection will during the operation of the motor saw remain below the maximum permissable values.

These objects and other objects and advantages of the invention will appear more clearly from the following specification in connection with the accompanying drawings, in which:

FIG. 3 is a modified embodiment of the invention in an illustration similar to that of FIG. 1.

FIG. 4 is a side view of FIG. 3.

FIG. 5 represents a view of a third embodiment of the muffler according to the invention and illustrated similar to FIG. 1.

FIG. 6 is a side view of FIG. 5.

FIG. 7 illustrates a bend or discharge knee for an exhaust according to the invention with particularly advantageous turbulence creating means.

FIG. 8 shows a further modification of the muffler of FIG. 1.

FIGS. 9 and 10 respectively illustrate two different covers for the arrangement of FIG. 8.

The muffler according to the present invention comprises an exhaust gas receiving chamber which is defined by a chamber wall and by a pan-shaped housing wall including an inlet for the exhaust gases. The muffler according to the invention is characterized primarily in that on the inside surface of the chamber wall there is arranged an exhaust gas conveying passage communicating with the exhaust gas chamber and being adapted to deflect an exhaust gas current by preferably 90°. The said passage is adapted to convey this deflected exhaust gas current through an aperture in the chamber wall. Above said aperture on the outside of the chamber wall and projecting therefrom there is provided a bend from which the exhaust gas current through an outlet in the bend flows at least approximately parallel to a portion of the chamber wall. The muffler according to the invention is furthermore characterized in that transverse to the out-flow direction of the exhaust current and spaced from the last mentioned outlet there is provided at least one turbulence creating muffler for creating turbulence in the exhaust current having passed through the outlet.

Figure 2:
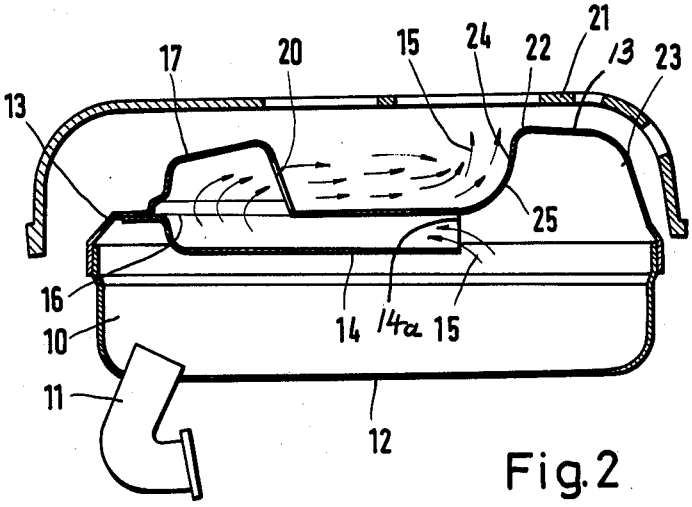
FIG. 2 shows a vertical longitudinal section taken along the line II—II of FIG. 1.
Figure 1:
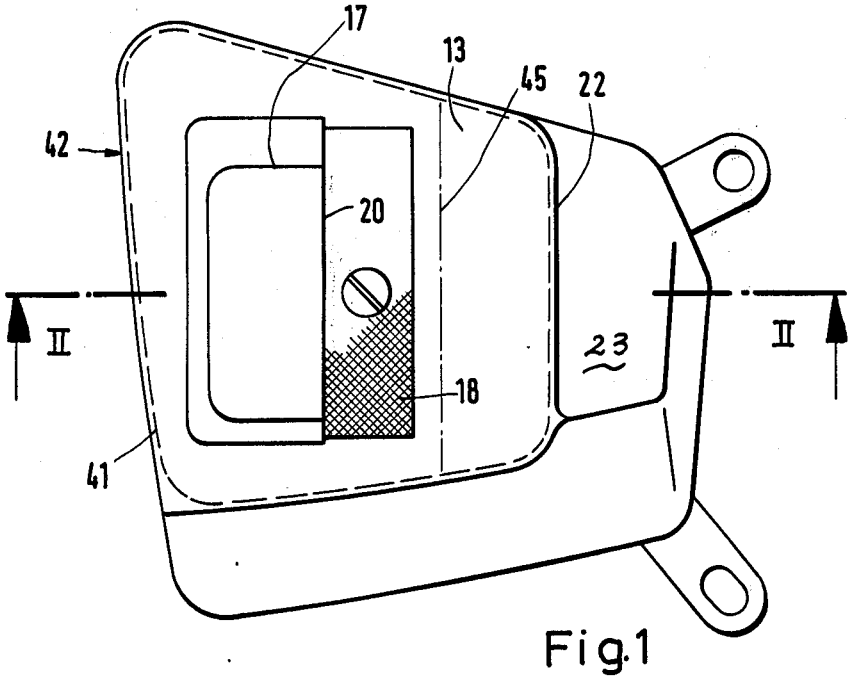
FIG. 1 is a side view of a first embodiment of a fire protective muffler of a motor chain saw in conformity with the present invention.

Referring now to the drawings in detail, the muffler illustrated in FIGS. 1 and 2 is intended for a portable internal combustion engine (not shown in the drawings) as drive for a motor chain saw. The muffler has a chamber 10 provided with an inlet 11 for receiving the exhaust gases from the internal combustion engine. The chamber 10 is defined by a pan-shaped housing wall 12 into which the exhaust gases pass through the inlet 11 of which only the manifold leading into the chamber 10 is shown. The chamber 10 is furthermore defined by a chamber wall 13 which is placed on the free rim of the housing wall 12. The chamber wall 13 is at its inner side provided with a discharge gas passage 14 which is U-shaped in cross section and has an open end face 14*a* through which the exhaust gases enter the passage 14 as indicated by the arrows 15. The passage 14 at said end face 14*a* brings about a deflection of the waste gases 14 by about 90° and conveys said exhaust gases through an aperture 16 provided in the chamber wall 13. Above said apertures 16 there is provided a bend 17 which projects upwardly (with regard to FIG. 2) from container or chamber wall 13. This bend deflects the exhaust gases, as will be seen from FIG. 2, by a further 90° so that the exhaust gases after having passed through a fine mesh screen 18 covering the aperture 16 can escape through the outlet opening 20 of the bend and are able to pass at least approximately parallel to the chamber wall 13 along the central surface thereof.

According to the embodiment illustrated in FIGS. 1 and 2, a protective grate 21 is arranged above and slightly spaced from container or chamber wall 13. The protective grate 21 has a plurality of transverse and longitudinal ribs or fins arranged in spaced relationship to each other, between which a sufficient convexion for the heat radiating from the chamber wall 13 and for the exhaust gases themselves will be assured. The protective grate or cover 21 is intended to form the contact protection for the muffler proper. In conformity with governmental protective regulations, the exhaust gases leaving through the mantle surface of the protective grate 21 as well as the surface of the grate or cover 21 itself must not exceed permissible maximum temperature limit values.

In order to safeguard that the discharged exhaust gases cannot exceed permissible maximum temperatures, means are provided by which the exhaust gases prior to passing through the protective grate 21 are subjected to a strong turbulence so that by mixing with the surrounding air they will considerably cool. These means for increased turbulence of the exhaust current comprise primarily an edge 22 arranged on the outside of the chamber wall 13, and a bulge 23 formed onto the chamber wall 13. The turbulence edge 22 is provided at the outer end of a transverse wall 24 which faces the outlet opening 20 and the bend 17. The transverse wall 24 projects toward but is arranged in spaced relationship to the protective grate 21 and through a rounded section 25, as seen in FIG. 2, merges with the central plane portion of the chamber wall 13, which plane portion carries the bend 17. Due to the sudden change in the direction of the transverse wall 24, the exhaust gases undergo a strong turbulence at the edge 22 as a result of which the exhaust gas temperature will be markedly reduced.

In addition to such turbulences caused by the transverse wall 24 and the edge 22, further interference elements could be provided by means of which the turbulence and the splitting up of the exhaust gas current would be increased whereby the intermixing of the exhaust gas with the surrounding air would be further improved. With the embodiment illustrated in FIGS. 3 and 4, an angle member 27 is employed as interfering element. This angle member comprises a base plate 28 placed upon the screeen 18, and furthermore comprises a leg section 29 which vertically projects from said base plate 28. The leg member 29 is directly behind the opening 20 of bend 17 so placed in the exhaust gas current and is by a common holding screw so fastened that the exhaust gas current is split up at the leg member 29 whereby it will be considerably deflected. As will be seen from the side view shown in FIG. 4, the leg member may be adapted to the inclination of the bend opening 20. This brings about that the exhaust gases being discharged are deflected toward the central zone 31 of the chamber wall 13 which central zone carries the bend 17.

According to the embodiment of FIGS. 5 and 6, the interfering element 33 comprises a base plate 34 forming a rectangular isosceles triangle. At the angle sides of the base plate 34, two walls 35 and 36 extend upwardly which divide the exhaust gas current leaving the bend 17 and deviate the same laterally whereby the exhaust gas current will be subjected to great turbulence.

With the embodiment of FIG. 7, the bend 17 has an end face 38 which greatly narrows the exit cross section 20 and which is bent toward the central zone carrying the bend 17. This end face 38, in the specific showing of FIG. 7 comprises five bores 39 through which the exhaust gas current can pass and is subjected to a strong turbulence as desired. Instead of the illustrated bores 39, it is possible to provide slots, or it is also possible to stamp out ears which are bent out of the plane of the end face 38 and furnish a sufficient passage for the exhaust gases while simultaneously assuring that the exhaust gases will be subjected to turbulence in the desired manner.

The muffler illustrated in FIG. 8 in a longitudinal section has a cover plate 40 which is adapted to cover the region indicated by dash lines 41 in FIG. 1 between the edge 22 and the wider end face 42 of the chamber wall 13. In the section of FIG. 8, in contrast to the arrangement of FIG. 1, the cover plate 40 extends only up to the area where it can rest on the bend 17. For an improved turbulence of the exhaust gases 14, the cover plate 40 has a plurality of nub-shaped protrusions which may be semi-spherical and which are arranged directly adjacent semi-circular openings 44 (FIGS. 9 and 10) from which the waste gases indicated by short arrows can exit. For purposes of obtaining a strong turbulence, the openings 44 are directed toward each other. According to the arrangement of FIG. 9, the protrusions or bulges 43 are arranged in rows one behind the other or one adjacent to each other. With the arrangement of FIG. 10, the nubs and their pertaining openings 44 are offset relative to each other. Due to the protrusions 43 and the openings 44, an additional deflection and turbulence of the exhaust gas current is obtained while the exhaust gas current has to move through a longer path, and furthermore an additional turbulence effect is created whereby a lower exhaust gas temperature will prevail at the protective cover 21 which determines the respective area to be measured.

In FIG. 1, the dash line 44 indicates that the cover plate 40 can be made considerably shorter than illustrated in FIG. 8. In spite of its reduced length from the edge 22 to line 45 (FIG. 1), due to the nub-shaped protrusions 43 shown in FIGS. 9 and 10, and the pertaining openings 44 directed against each other, a strong turbulence of the exhaust gases and consequently a strong reduction in the temperature of the gases passing through the protective grate 21 will be assured.

A further considerably reduction in the temperature of the exhaust gases can be obtained by the fact that according to FIG. 8, a portion of the cooling air anyhow delivered by a ventilator wheel of the internal combustion engine, which cooling air is indicated in FIG. 8 by an arrow 46, is introduced between the chamber wall 13 and the protective grate 21. The cooling air 46 intermixes with the exiting exhaust gases. In this connection, it is particularly advantageous that the protective grate 21 in its feeding region extending over the bend 17, has no perforations.

According to an embodiment of the design of the bend 17 shown in FIG. 7, the end face 38 may be comb-shaped, in which instance it is particularly advantageous to set the teeth forming one piece with the hood of the bend 17, about their longitudinal axes.

As a result thereof, a very satisfactory turbulence of the exhaust gas current can be obtained without having to provide an additional interfering element.

It is, of course, to be understood that the present invention is by no means limited to the specific showing in the drawings, but also comprises any modifications within the scope of the appended claims.

What we claim is:

1. A muffler, especially for a portable internal combustion engine of a motor chain saw, which includes an exhaust gas receiving container defined by a container wall having an aperture therethrough and by a pan-shaped housing wall having an inlet for admitting exhaust gas into said container, exhaust gas conveying means communicating with said exhaust gas container for receiving and deflecting an exhaust gas current and conveying the deflected exhaust gas current through said aperture, said exhaust gas conveying means comprising bend means arranged on the outside of said container wall and projecting from said container wall and being provided with an outlet for conveying the exhaust gas current through said outlet at least approximately parallel to a portion of said container wall, and turbulence creating means extending transverse to the outflow direction of the exhaust gas current through said outlet for creating turbulence in the last mentioned exhaust gas current.

2. A muffler according to claim 2, in which said turbulence creating means include an edge on the outside of said container wall.

3. A muffler according to claim 2, in which said edge forms a corner section of said container wall.

4. A muffler according to claim 3, in which said container wall has a rounded section interconnecting said corner section and that portion of said container wall which is located between the container wall portion having said bend means arranged thereon and said corner section.

5. A muffler according to claim 1, in which at least one turbulence creating means is arranged at said outlet of said container wall.

6. A muffler according to claim 5, in which said turbulence creating means at said outlet includes an angle member comprising a leg extending into the path of an exhaust gas current exiting from said bend means.

7. A muffler according to claim 6, in which said angle member comprises a base plate connected to said container wall, and a leg member bent off from said container wall and extending into the path of said exhaust gas current.

8. A muffler according to claim 5, in which said at least one turbulence creating means comprises a triangular base plate having a tip directed in a direction counter to the direction of flow of the exhaust gas, said triangular base plate also comprising two side walls extending at least nearly perpendicular relative to each other.

9. A muffler according to claim 5, in which said bend means has an end face reducing the through-flow of the exhaust gas current, said end face being provided with perforations forming passages for the through-flow of the exhaust gases.

10. A muffler according to claim 5, in which said bend means has an end face reducing the through-flow of the exhaust gases, said end face being provided with comb-shaped teeth set preferably about the longitudinal axis of said teeth.

11. A muffler according to claim 5, in which said bend means has an end face reducing the through-flow of the exhaust gases, said end face being provided with comb-shaped teeth forming one single piece with said bend means.

12. A muffler according to claim 1, which includes a cover extending at least approximately parallel to the flow path for the exhaust gases leaving said bend means and reaching at least up to the edge at the outside of said container wall.

13. A muffler according to claim 12, in which said cover is of sheet metal and comprises a plurality of bulges with adjacent openings.

14. A muffler according to claim 13, in which said openings are grouped in pairs with the openings of each pair facing toward each other.

15. A muffler according to claim 1, which includes a protective grate extending in spaced relationship to and over at least said bend.

16. A muffler according to claim 15, in which said protective grate and said chamber wall form with each other a channel for passing cooling air therethrough.

17. A muffler according to claim 16, in which said protective grate forms a solid plate section in the region of the exhaust gas flow prior to said exhaust gas flow leaving said bend, and in which said chamber wall in the vicinity of said bend is provided with an outlet opening for passing exhaust gas therethrough.

* * * * *